United States Patent [19]

Thompson

[11] 4,343,110

[45] Aug. 10, 1982

[54] WEATHER STRIPPING APPARATUS

[76] Inventor: Eileen Thompson, Rte. 1, Barnesville, Minn. 56514

[21] Appl. No.: 113,448

[22] Filed: Jan. 21, 1980

[51] Int. Cl.[3] ..... E06B 7/16

[52] U.S. Cl. ..... 49/477; 49/488; 49/498

[58] Field of Search ..... 49/477, 488, 475, 498

[56] References Cited

U.S. PATENT DOCUMENTS

| | | | |
|---|---|---|---|
| 465,708 | 12/1891 | Bishop . | |
| 795,120 | 7/1905 | Harris et al. . | |
| 1,972,431 | 9/1934 | Timmis | 49/488 |
| 2,612,664 | 10/1952 | Sidden | 49/488 X |
| 2,686,343 | 8/1954 | Harpoothian et al. | 49/477 |
| 2,825,941 | 3/1958 | Lux et al. . | |
| 2,969,252 | 1/1961 | Gruver | 49/498 X |
| 3,100,918 | 8/1963 | Coverley . | |
| 3,366,032 | 1/1968 | Alamprese . | |
| 3,518,793 | 7/1970 | Hirtle | 49/488 |
| 3,531,896 | 10/1970 | Dean | 49/488 |
| 3,555,734 | 1/1971 | Hirtle et al. . | |
| 3,581,884 | 6/1971 | Caldwell et al. | 49/475 X |
| 3,745,707 | 7/1973 | Herr . | |
| 3,747,275 | 7/1973 | May et al. . | |
| 3,831,950 | 8/1974 | Bentley et al. . | |
| 3,968,597 | 7/1976 | Hirtle . | |

*Primary Examiner*—Philip C. Kannan

*Attorney, Agent, or Firm*—Merchant, Gould, Smith, Edell, Welter & Schmidt

[57] ABSTRACT

A weather stripping apparatus for use around doors or windows. The apparatus comprises a flexible elongate tubular member which is generally flat and has a plurality of openings along the front edge. Self-adhesive tape is provided for attachment of the apparatus to the area to be insulated. The openings are exposed to the air whose flow is to be inhibited. Any movement of the air caused by wind or the like will cause the air to enter the openings and inflate the weather stripping apparatus, sealing gaps between the door or window and its frame through which air would normally flow.

1 Claim, 6 Drawing Figures

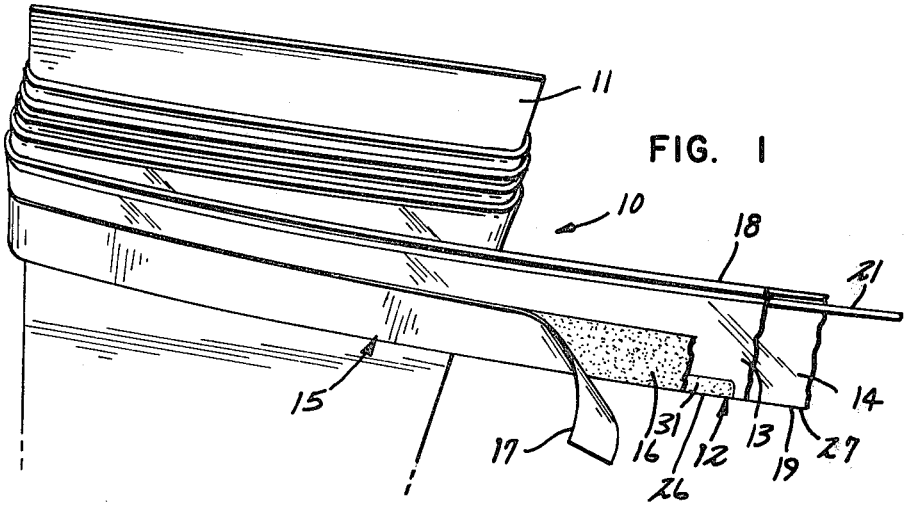
FIG. 1
FIG. 2
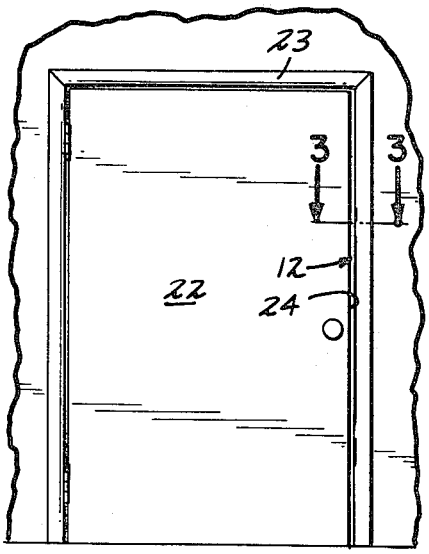
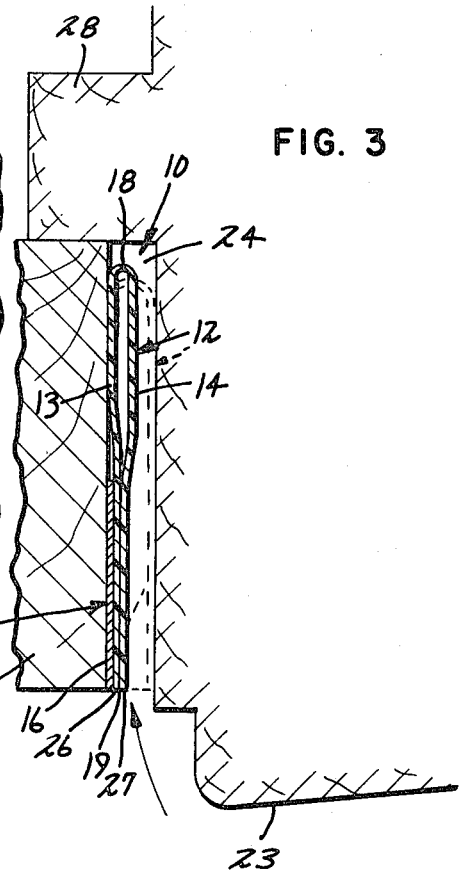
FIG. 3

WEATHER STRIPPING APPARATUS

TECHNICAL FIELD OF THE INVENTION

This invention relates generally to insulating devices used to eliminate the unwanted flow of air around doors or windows. More particularly, the invention relates to those devices which utilize the flow of air to inflate a sealing member causing it to expand and close any gaps around the door or window through which air might normally pass.

BACKGROUND OF THE PRIOR ART

A recurring problem assoicated with doors or windows is that of unwanted air seepage around the window or door and into the structure in which they are mounted. The difficulty in the solution of this problem is that the space or gaps between the window or door and their frame can vary greatly depending upon the particular construction. Because of this fact prior art insulating devices have been unable to perform satisfactorily under all conditions. For example, if the gap between the door or window and its frame is large the insulating device must be adapted to fill that space. However, around the same door or window there may be other areas where no space exists. In that case the insulating device must be small enough so that it will not interfere with the opening or closing action of the door or window. Also, over a period of time doors, windows, or their frames may warp. When warpage occurs the configuration of spaces or gaps between the frame and the door or window may occur. It is Applicant's belief that none of the devices in the prior art have been versatile enough to be able to insulate areas where large gaps exist and yet still be small enough so that they do not interfere with the proper function of the door or window at points where the gap is minimal or nonexistent.

BRIEF SUMMARY OF THE INVENTION

The present invention comprises an elongate flexible tubular member that is generally flat. It is defined by a front edge, a back edge, two side portions, and two opposite end portions. A fastening means is used to secure one side of the tubular member to the area where insulation is desired so that the front edge of the tubular member is exposed to the air whose flow is to be inhibited. A plurality of openings along the front edge of the tubular member define a passage which allows air to enter and inflate the tubular member. This inflation causes the tubular member to expand and effectively seal any gaps through which air would normally flow.

In the preferred embodiment of the invention the tubular member is constructed from a single elongate flexible member. The flexible member is folded in half lengthwise. The edges which are folded upon one another are sealed in a non-continuous manner leaving openings along the front edge.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

FIG. 1 is a perspective view of the weather stripping apparatus before it is attached.

FIG. 2 is the front view of a door in its frame between which the weather stripping is applied to the door.

FIG. 3 is a fragmentary section of a door taken generally along line 3—3 in FIG. 2 showing the position of the weather stripping between the door and its frame.

DETAILED DESCRIPTION OF THE INVENTION

Figure 4:
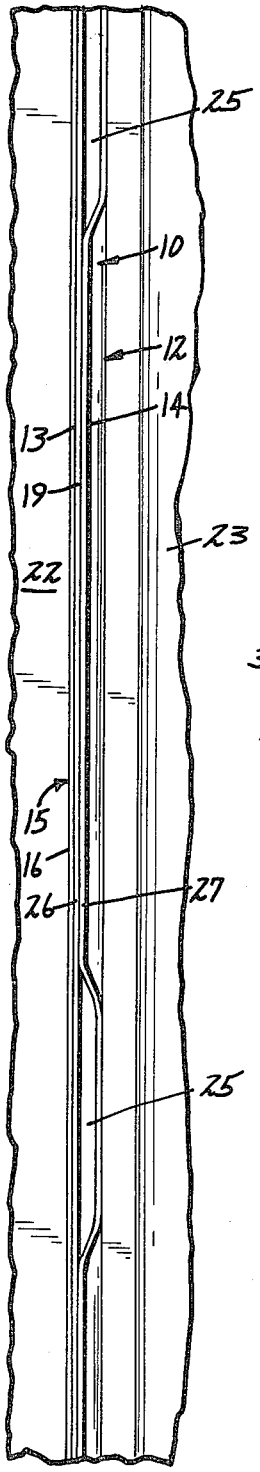
FIG. 4 is a fragmentary view of a door and its frame showing the position of the weather stripping in the space therebetween.

In FIG. 1 the weather stripping apparatus 10 is shown wrapped around a holder 11 as it appears before application. The weather stripping apparatus 10 is seen to comprise an elongate tubular member 12 made up of two sides 13 and 14, a back edge 18, and a front edge 19. Tubular member 12 can be made of any non-porous flexible material. In the preferred embodiment shown it is comprised of clear flexible plastic. Attached to side 13 of tubular member 12 is section of tap 15. The outwardly facing adhesive side 16 of tape 15 has a pealable covering 17 which is removed when the weather stripping apparatus 10 is to be mounted. The tape 15 is preferably a self-adhesive type of tape. Other types of self-adhesive could also be used for attaching the apparatus 10. Enclosed between sides 13 and 14 of tubular member 12 is string 21. String 21 is provided to ensure that sides 13 and 14 will maintain a minimum amount of separation during the time before weather stripping apparatus 10 is applied. This prevents sides 13 and 14 from collapsing or creasing which would cut down on the efficiency of weather stripping apparatus 10. String 21 is removed before weather stripping apparatus 10 is applied.

Weather stripping apparatus 10 can be used to insulate the area around numerous types of doors or windows. One such application for weather stripping apparatus 10 is shown in FIGS. 2, 3, 4, and 6. These figures show weather stripping apparatus 10 as it would be used to insulate the area between a door and its frame. It should be noted that this use constitutes but one embodiment of a use of the invention and that weather stripping apparatus 10 could be used to insulate other types of doors as well as numerous varieties of windows.

In FIG. 2 a door 22 is surrounded by a door frame 23 defining a gap 24 between the door 22 and door frame 23. It is through gap 24 that unwanted air may flow from outside of door 22 into the structure to which it is attached. To block this flow of air weather stripping apparatus 10 is attached to the door 22 within gap 24 as shown in FIG. 3.

With reference to FIG. 3, door 22 can be seen to rest against door stop 28. Door frame 23 is spaced a small distance from door 22, this distance defining gap 24. The weather stripping apparatus 10 is attached to door 22 by removing peelable covering 17 from tape 15 and then pressing adhesive side 16 to door 22. Weather stripping apparatus 10 is constructed so that as air flow indicated by the arrow enters gap 24 it causes expansion of tubular member 12. The expanded position of tubular member 12 is shown in phantom in FIG. 3.

Figure 5:
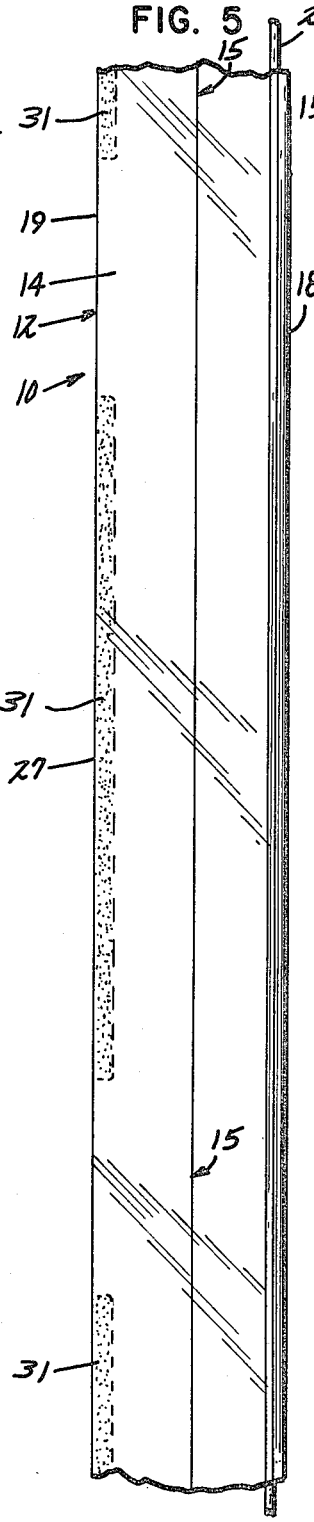
FIG. 5 is a fragmentary side view of the weather stripping apparatus.

FIGS. 4 and 5 show the special construction of tubular member 12 which allows it to expand and conform its size to the shape of gap 24 in order to effectively stop any flow of air which could enter between door 22 and door frame 23. Tubular member 12 is seen to comprise openings 25 through which air may pass. As the air passes through openings 25 it causes tubular member 12 to inflate so that it completely fills gap 24 effectively blocking the flow of air which would normally pass through to the inside of the structure.

FIGS. 3, 4 and 5 show the preferred embodiment of the construction of tubular member 12. With reference to FIG. 3, it can be seen that a single elongate flexible member having side edges 26 and 27 is folded so that the edges 26 and 27 come together to form front edge 19 of tubular member 12. The width of the flexible member can be varied according to the size of the window or door to be insulated. For example, an unfolded width of $2\frac{5}{8}$ inches has been found to work effectively for most standard size windows or doors. In FIGS. 4 and 5 it can be seen that side edges 26 and 27 are affixed to one another along front edge 19 in a noncontinuous manner at portions 31. The area along the front edge 19 between portions 31 defines openings 25. For maximum efficiency the size of portions 31 should be larger than openings 25. For example, a ratio between portions 31 and opening 25 in the range of 3 or 4 to 1 has been found to work effectively. To further increase the insulating capabilities the ends of weather stripping apparatus 10 can be sealed. One way this can be done is to cut weather stripping apparatus to a length slightly longer than the section where it is to be applied. The opposite end portions can then be folded around the corners of the door for a certain distance, for example $\frac{1}{2}$ inch. This prevents air from escaping at the end portions.

Figure 6:
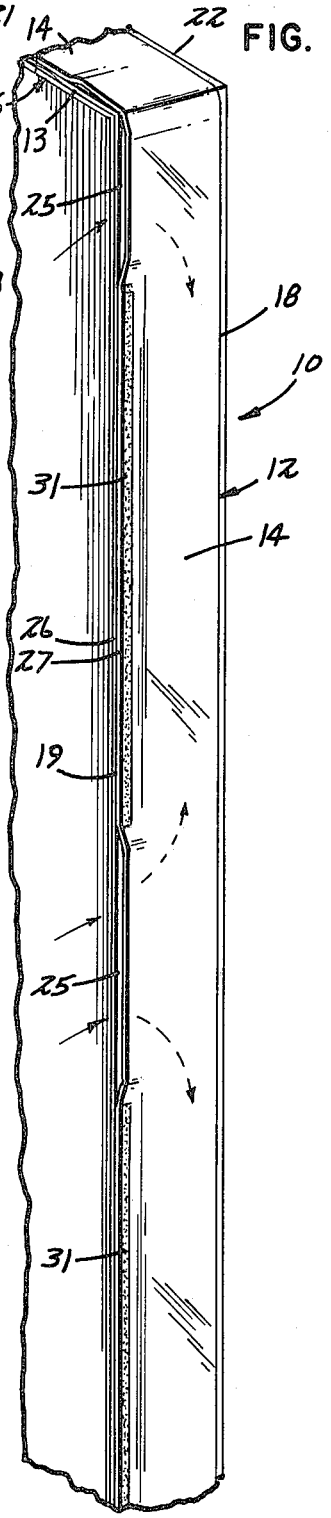
FIG. 6 is a perspective view of a section of the weather stripping apparatus attached to a door.

The operation of weather stripping apparatus 10 can be understood with reference to FIGS. 4 and 6. The arrows indicate the flow of air through openings 25 into tubular member 12. As the air enters it flows through tubular member 12 causing it to conform its shape to the size of any gaps which exist. This provides an effective weather stripping insulation between the door and the frame.

It can thus be understood that as the flow of air increases the pressure inside tubular member 12 also increases. The increased pressure causes a greater tendency to expand causing the tubular member to more tightly block the gap between the door and its frame. The effect is that as air flow increases, for example due to high winds, the insulation capabilities of weather stripping 10 also increases. Thus, this unique invention will provide the most effective insulation when it is most needed. Because tubular member 12 is flexible., variations in the size of the gap due to warpage or other causes present no problem. The shape of tubular member 12 will conform to the gap variation with the result that there is no decrease in the insulation efficiency of weather stripping apparatus 10.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent extended by the broad general meaning of the terms in which the appended claims are expressed.

What is claimed:

1. A weather stripping apparatus used to inhibit the flow of air between doors or windows and adjoining surfaces, said weather stripping apparatus comprising:

an elongated planar flexible member defined by two side edges extending in a longitudinal direction and two ends, said member being folded along its longitudinal direction and the side edges being joined to form a front edge, the side edges being affixed to one another along the front edge in a non-continuous manner such that the side edges define a plurality of openings along the front edge of said flexible member, said flexible member having a hollow tubular shape which is generally flat defined by the front edge, a back edge, two side portions, and two opposite end portions, said openings along said front edge being adapted to face outwardly from a structure toward the direction of the flow of air whereby air can enter the hollow interior of said tubular shaped flexible member to inflate said tubular member and seal gaps between doors or windows and adjoining surfaces of said structure, thereby preventing unwanted air from flowing into the structure, said flexible member including a length of removable string, said string being disposed within said flexible member along its full length and operable to cause the side portions of said flexible member to be separated.

* * * * *